US005160291A

United States Patent [19]

Sexton

[11] Patent Number: 5,160,291

[45] Date of Patent: Nov. 3, 1992

[54] CHIMNEY DAMPER

[75] Inventor: Walter Sexton, Foster, Ky.

[73] Assignee: Lyemance International, Inc., Jeffersonville, Ind.

[21] Appl. No.: 706,896

[22] Filed: May 29, 1991

[51] Int. Cl.[5] ..... F23L 17/02

[52] U.S. Cl. ..... 454/7; 126/286

[58] Field of Search ..... 126/286; 454/5, 7, 30, 454/31

[56] References Cited

U.S. PATENT DOCUMENTS

| | | | |
|---|---|---|---|
| 2,048,216 | 7/1936 | Parker et al. | 454/5 |
| 2,328,332 | 8/1943 | Filkins | 126/286 X |
| 4,154,150 | 5/1979 | O'Leary | 454/7 |
| 5,080,006 | 1/1992 | Vonsick | 454/7 |

FOREIGN PATENT DOCUMENTS

| | | | |
|---|---|---|---|
| 634390 | 2/1928 | France | 454/199 |
| 2544 | of 1854 | United Kingdom | 454/7 |

*Primary Examiner*—Harold Joyce

*Attorney, Agent, or Firm*—Scott R. Cox

[57] ABSTRACT

A chimney flue damper comprised of a generally rectangular frame, a damper flap pivotally mounted to the frame, a bar and extension pin element secured to the bottom of the damper flap and a cable. The bar and extension pin element is rotatably secured to the bottom of the damper flap. When the extension pin of the bar and extension pin element is extended, it passes through an extension pin opening in the damper flap to strike the bottom of the flange of the frame and thus open a damper flap which is stuck closed, either by ice forming on the seal between the damper flap and the frame or as a result of an accumulation of foreign material around the edge of the damper flap.

10 Claims, 4 Drawing Sheets

CHIMNEY DAMPER

BACKGROUND OF INVENTION

1. Field of Invention

This invention relates to chimney dampers. More particularly, this invention relates to an improved chimney damper containing a means for opening the chimney damper even when it is stuck closed.

2. Prior Art

In homes and other buildings having a fireplace, the fireplace opening is connected to a chimney flue which is open to the outside of the building. When in use, the combustion products from the fireplace pass up through the flue and exit the chimney in a conventional fashion.

When the fireplace is not in use, however, the fireplace opening and chimney flue form a passage through which heat can escape from the interior of the building. Although most fireplaces contain conventional fireplace dampers at the bottom of the flue or immediately above the fireplace opening, these fireplace dampers do not usually provide an adequate seal for the chimney flue. This inadequate seal permits a great deal of heat loss through the chimney flue.

A number of chimney dampers have been produced which are mounted on the top of the chimney to provide a better seal and thus reduce the amount of heat lost through the chimney flue. Various types of chimney dampers are available. For example, one well known type of chimney damper is a cap-type flue damper as shown in U.S. Pat. Nos. 4,554,863, 4,181,119 and 4,020,754.

Another common type of chimney damper has a lid attached to the side of the chimney by hinges as shown in U.S. Pat. Nos. 4,691,624, 4,528,897, 4,483,315, 4,368,663 and 2,856,839.

Another common type of chimney damper contains a frame secured to the top of the chimney and a flap which is pivotally attached to the frame to provide an improved method of both closing the flue and also preventing air and water from flowing over the damper flap into the chimney. See, for example, U.S. Pat. No. 2,704,502 and the particularly preferred inventions shown in U.S. Pat. Nos. 3,945,307 and 4,165,679.

A disadvantage of many of the previously known dampers is that the exposed surface of the damper contains areas in which water may collect. This water, upon freezing, can lock the damper in a closed position creating a safety hazard for operation of the fireplace. One method of solving this problem was proposed in U.S. Pat. No. 3,945,307 which discloses a cup (15) which is attached to a spring (13) secured to the bottom of a damper flap (7) such that when the spring is stretched and then released, the cup moves abruptly upward to strike the underside of the damper flap. This striking of the damper flap is designed to free a stuck damper flap. While this method of freeing a stuck damper flap works in some situations, improved methods of releasing a stuck damper flap are still needed to assure that the damper flap never remains in a closed position as a result of the accumulation of ice, creosote or other material build up.

Accordingly, it is an object of this invention to provide a chimney damper containing a device which frees a stuck damper flap.

It is another object of this invention to provide a chimney damper which operates under many different weather conditions.

It is a still further object of this invention to provide a chimney damper which is easy to install and inexpensive to produce.

These and other objects are obtained by the improved chimney damper of the instant invention.

SUMMARY OF INVENTION

The instant invention is an improved chimney damper comprised of a generally rectangular frame containing a substantially u-shaped inwardly turned channel, an upstanding damper flap which is pivotally mounted on the frame, a spring member secured to the bottom side of the damper flap, a bar and an extension pin element secured to the bottom of the damper flap, wherein an extension pin of the bar and extension pin element can be extended through the surface of the damper flap to strike a portion of the frame and thus free the damper flap if it is stuck in a closed position and a cable secured to the spring and the bar and extension pin element. The operation of this device prevents a damper flap from remaining stuck and allows the unsticking of the damper flap from inside the building containing the chimney. This device is an improvement over all existing chimney dampers.

BRIEF DESCRIPTION OF THE DRAWINGS

This invention will now be described with reference to the accompanying drawings in which.

DETAILED DESCRIPTION OF THE PREFERRED EMBODIMENT

Figure 1:
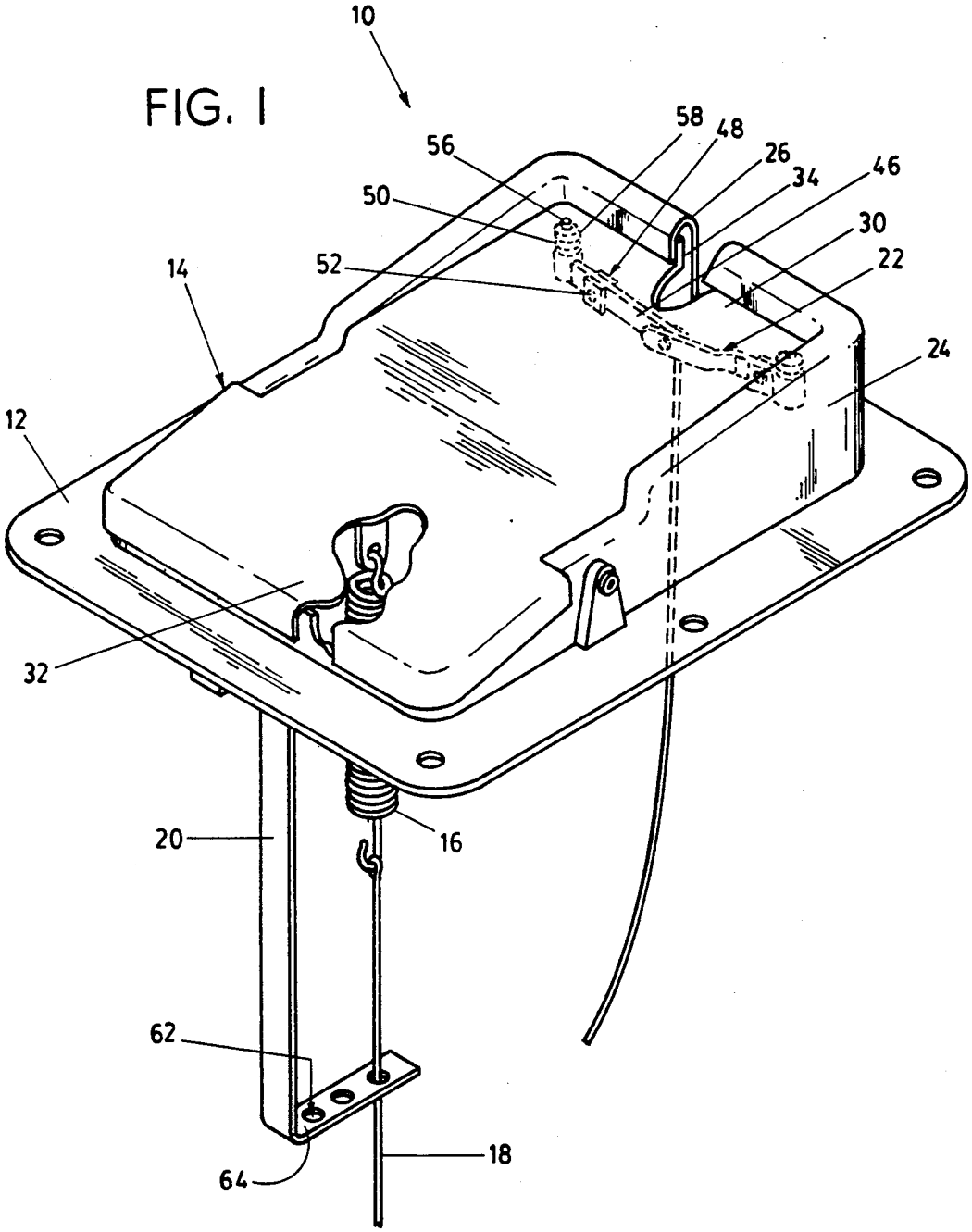
FIG. 1 shows a perspective view, partially in section, of the damper in accordance with the present invention in its closed position.

Although the invention is adaptable to a wide variety of uses, it is shown in the drawings for purpose of illustration as a chimney damper (10) comprised of a generally rectangular frame (12), an upstanding damper flap (14), a spring member (16), a cable (18), a support arm (20) and a bar and extension pin element (22). See FIG. 1.

The generally rectangular frame (12) is designed to rest on the top of the outlet of a flue of a chimney (not shown). The frame (12) includes an upstanding, generally rectangular flange (24) provided with an inverted channel member (26) at the top edge thereof which extends partially around the periphery of the flange. In an optional embodiment a sleeve (not shown) secured to the underside of the frame, can extend downwardly into the flue of the chimney to provide additional support for the chimney damper.

Figure 2:
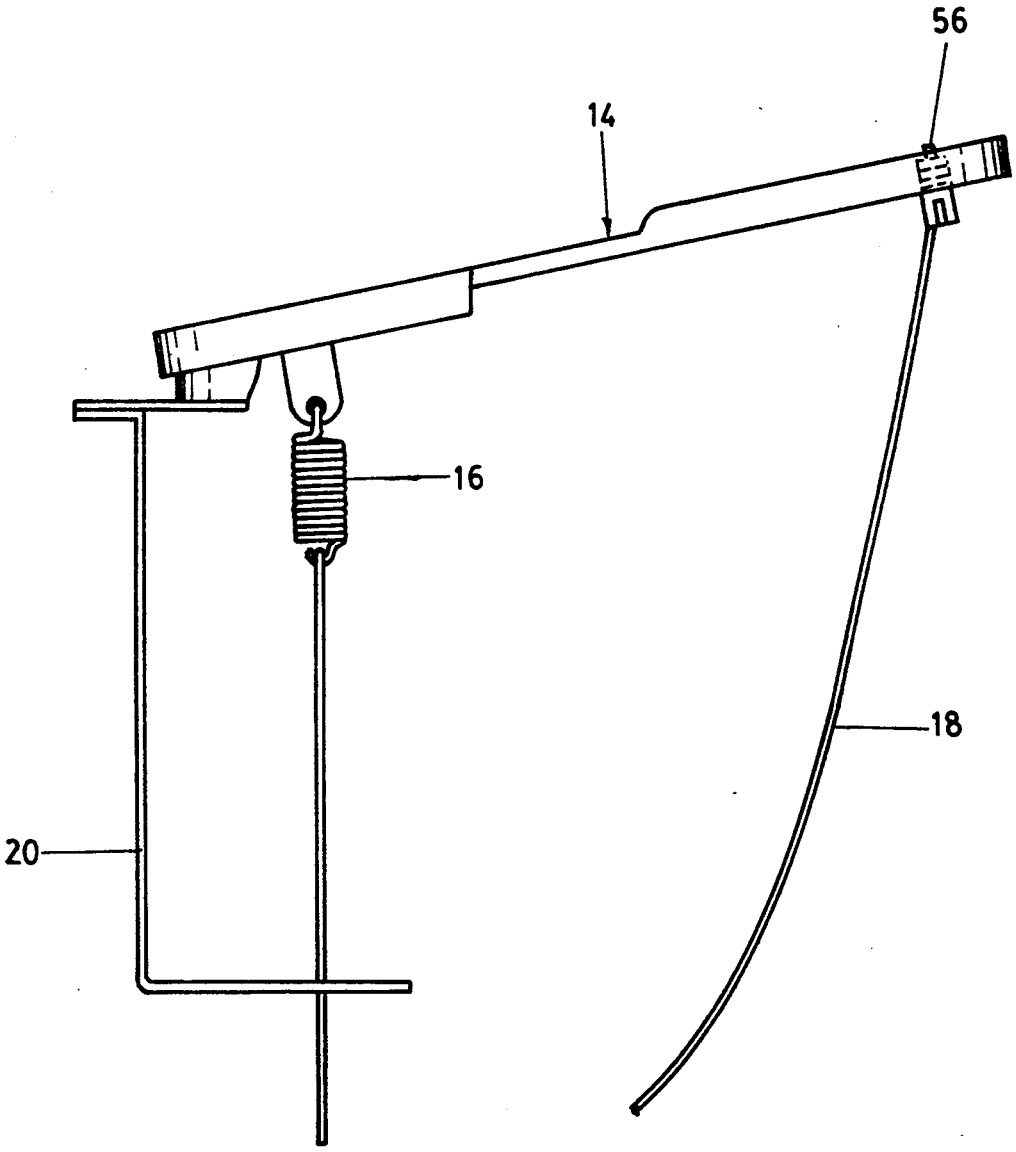
FIG. 2 presents a partially cut away illustration of the device shown in FIG. 1.

The damper flap (14) is secured to the frame (12), for example, by means of a pivot member (28). The damper flap (14) contains a first (30) and second end (32) on either side of the pivot member (28) wherein said first end (30) is significantly longer and heavier than the second end (32). The damper flap includes a downwardly extending lip around a portion of the second end (32) which extends beyond the limits of the flange. An upstanding flange (34) is provided around the first end of the periphery of the flap to be received in the channel (26) of the frame to provide a seal between the flange and damper extending substantially around the flange and the periphery of the damper. When the damper flap (14) is closed, the upstanding flange (34) of the damper flap is in engagement with the inverted channel member (26) of the frame. When the damper flap (14) is unrestrained, the damper flap rotates about the pivot member (28) out of engagement with the channel member (26) to an open, generally vertical position exposing an opening in the chimney damper. See FIG. 2.

The pivot member (28) is preferably a pivot bar (36) running through openings in the sides of the frame and is secured to the bottom of the damper flap through a pair of pivot member braces (38). The pivot member braces (38) are secured to the bottom of the damper flap (14) or, preferably are an element of the pre-cast, one-piece damper flap. The pivot bar (36) is held in place by conventional means at each end. Placed over the pivot bar (36) near one end is a pivot spring (40) which, by its interaction between the damper flap (14) and the frame (12), encourages the damper flap to an open position. If required, a weight (not shown) can also be secured to the damper flap to provide additional force tending to force the damper flap to an open position. By the combination of the gravitational forces due to the heavier first end (30) of the damper flap, an optional weight secured to the bottom portion of the first end (30) of the damper flap and the operation of the pivot spring (40), the damper flap (14) will be forced in to an open position if not restrained. The damper flap (14) will remain open unless secured shut by the occupant of the building in which the chimney is located.

A spring bracket (42) is secured to the underside of the second end of the damper flap or in a preferred embodiment the spring bracket (42) is an element of the pre-cast damper flap. The spring member (16) is connected to the spring bracket (42). Secured to the spring member (16) is the cable (18) which extends downward in the chimney to the fireplace. The cable is conventional as is shown for example in U.S. Pat. Nos. 3,945,307 and 4,165,679. The chimney damper (14) can be closed by pulling the cable (18) downward to force the damper flap (14) to a closed position. The chimney damper flap (14) remains closed when the cable (18) is secured in place by a latch element (not shown) which is well known in the industry. The spring member (16) provides tension on the cable (18) when it is pulled after the damper flap is closed to provide additional biasing to hold the damper flap (14) in a closed position and, thus, securely fasten the damper flap (14) in relation to the flange (24).

A sealing compound (not shown) can be provided on the top surface of the damper flap (14) to provide a better seal between the damper flap (14) and the frame (12).

Figure 3:
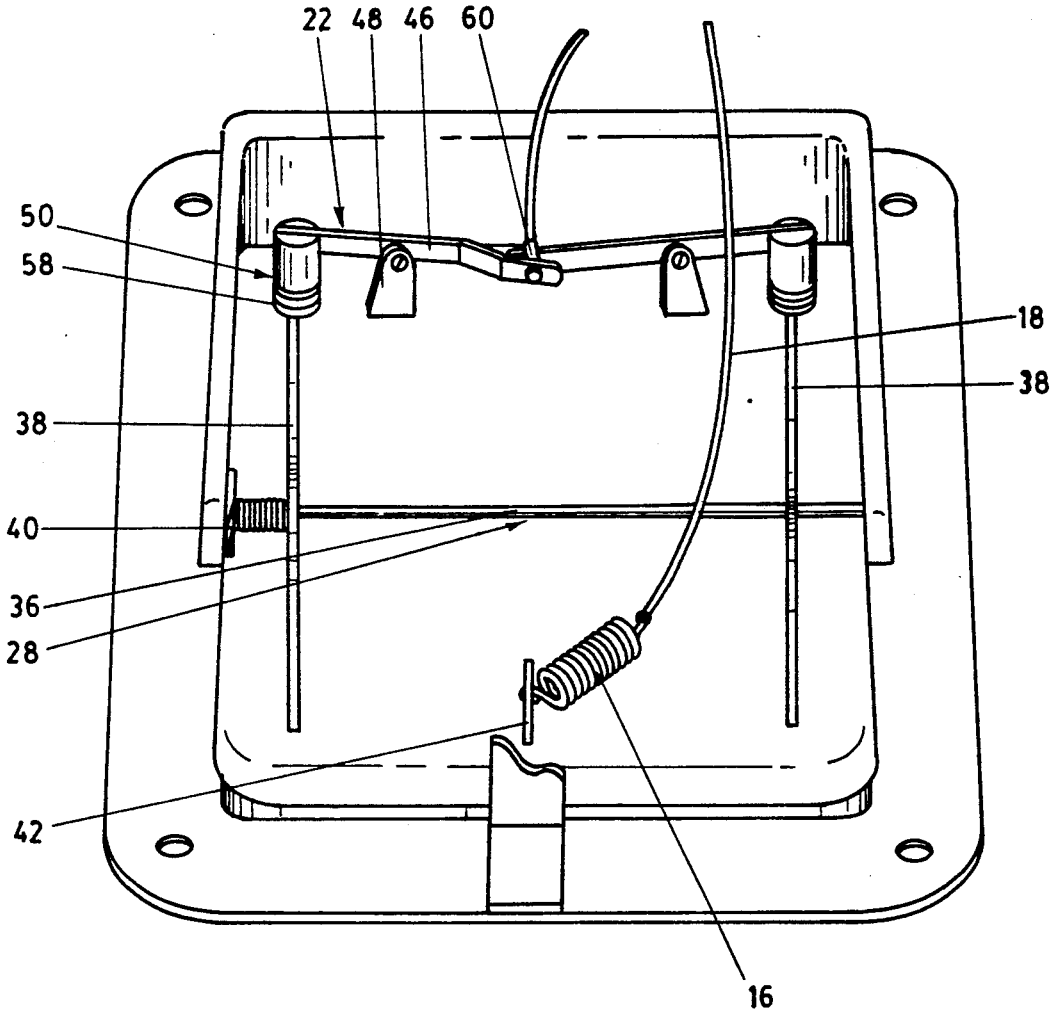
FIG. 3 shows a partially cut away, bottom view of the device shown in FIG. 1.

Secured to the bottom surface of the damper flap (14), adjacent to the edge of the second end (32) of the damper flap, is the bar and extension pin element (22). In a preferred embodiment, the bar and extension pin element (22) is comprised of a bar (46), a bar support bracket (48), and an extension pin member (50). The bar (46) is rotatably secured to the bar support bracket (48) wherein said bar support bracket (48) is secured to the bottom of the second end (32) of the damper flap or in a preferred embodiment the bar support bracket (48) is an element of the pre-cast damper flap. The bar is secured to the bar support bracket by any conventional means as long as the bar can rotate freely. Thus, in one preferred method a bar support pin (52) passes through the bar and through the bar support bracket (48) with sufficient space between the bar (46) and the bar support bracket (48) for free rotation of the bar (46) around the pivot point at the bar support pin (52). In a preferred embodiment, the bar support bracket (48) is located close to an extension pin opening (54) in the damper flap (14) to achieve greater leverage when the bar (46) is rotated. See FIG. 3.

Figure 4:
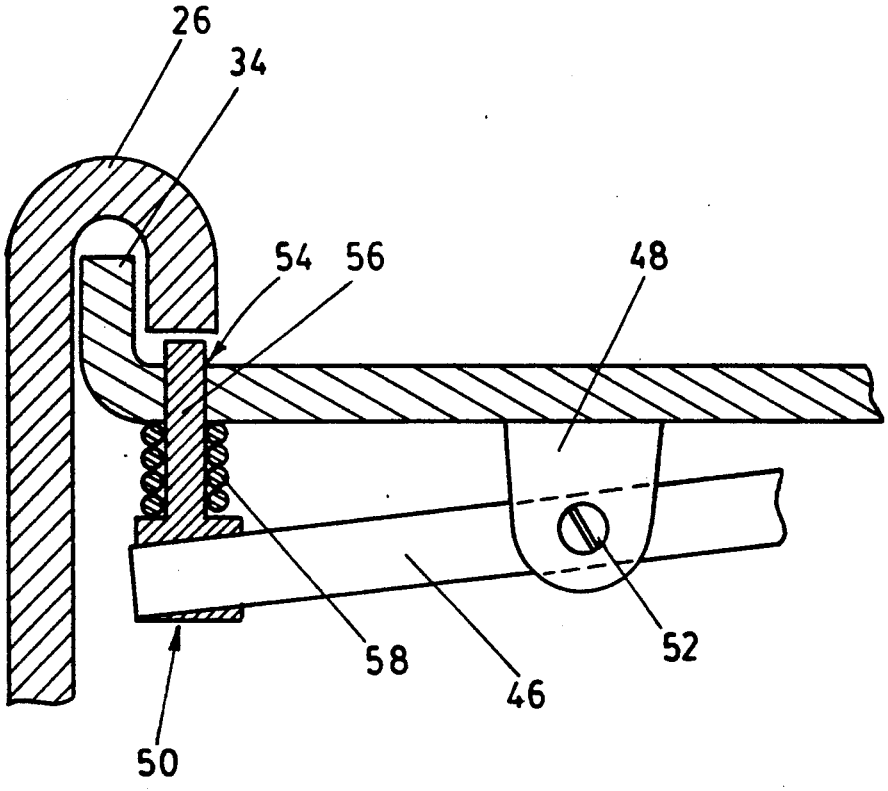
FIG. 4 is a cut away view of a portion of the bar and extension pin element.

Secured to one end of the bar (46) is the extension pin member (50) which is comprised of an extension pin (56) and an extension pin spring (58). See FIG. 4. The extension pin (56) when extended by the bar (46) passes through the extension pin opening (54) in the damper flap (14). When the damper flap (14) is closed and the extension pin (56) is extended by rotation of the bar (40), the extension pin (56) strikes the bottom surface of the flange (24) to force the damper flap open. The extension pin (56) is forced back through the extension pin opening (54) by the extension pin spring (58) which is attached around the extension pin (56) between the surface of the damper flap (14) and the remaining elements of the bar and extension pin element (22). See FIG. 4.

Secured to the opposite end of the bar from the extension pin is a loop (60) through which the cable (18) is attached. When the cable (18) is pulled beyond the normal damper closing position, the cable pulls on the bar (46) to force the extension pin (56) through the extension pin opening (54) to open the damper flap (14). In a preferred embodiment a pair of bar and extension pin elements (22) are secured to the bottom of the damper flap (14) located at opposite side edges of the damper flap. See FIG. 3. The ends of each extension bar opposite the respective extension pins are joined at a central location and the cable is attached at that joining point such that when the cable pulls the extension bars, the corresponding extension pins will be forced through corresponding extension pin openings to force the damper flap away from the surface of the flange. (See FIG. 3.)

The cable is attached both to the spring member (16) and to the bar and extension pin element (22). The cable (18) splits below the damper into two sections, one running to the spring member (16) and one running to the loop (60) of the bar and extension pin element (22). By pulling on the cable (18), two different operations are achieved. During the first portion of the pulling of the cable, the spring member (16) is extended which results in the second end (32) of the damper flap (14) being pulled downward, thus, closing the damper flap. In normal operation the cable (18) will then be secured by the latch element (not shown) to hold the damper flap closed. The split elements of the cable (18) are arranged such that a portion of the cable runs both to the spring member (16) and to the loop (60) of the bar and extension pin element (22). As the cable is pulled taut, the loop (60) and the corresponding end of the bar (46) are pulled away from the surface of the damper flap (14), thus forcing the extension pin (56) through the extension pin opening (54) to strike the flange (24), and thus force open the damper flap (14). See FIG. 4. The cable is then released to complete the opening of the damper flap.

The support arm (20) of the instant invention is an optional element of the invention and is attached to the rectangular frame. It is located so that at least one section of the cable (18) passes through an opening (62) at the bottom (64) of the support arm (20). While the support arm (20) is shown as an extended arm having an opening at the bottom, the support arm (20) may also take the form of a tube or other means such as a bottom eyelet which has a fixed bottom opening (62) through which the cable (18) or at least one section of the cable may pass.

In operation, the frame (12) of the chimney damper is placed on the top of the chimney and secured in place by a conventional securing means such as an adhesive, bolts, screws or other conventional means of securing. In an alternative embodiment, a sleeve may be secured to the bottom surface of the frame which will fit within the chimney. The damper flap (14) is normally biased in an open position and this open position is achieved by the pivot member (28) being off center so that the first end (30) of the damper flap (14) is heavier. In addition, the pivot spring (40) increases the bias of the damper flap (14) to an open position. The cable (18) or at least one section of the cable passes through the support arm (20) which assures that the cable (18) will pass directly downward through the chimney. To close the damper flap (14), the cable (18) is pulled and the cable (18) is fastened to the latch element (not shown) located near the fireplace. Upon release of the cable from the latch element, the damper flap (14) rotates open by gravitational forces and by pressure exerted by the pivot spring (40). This extends the damper flap (14) to a generally vertical position, opening the flue for use. In the event that the cable (18) breaks, the damper flap will always "fail safe" to an open position because of the gravitational forces placed on the first end (30) of the damper flap (14) and by operation of the pivot spring (40).

To increase the force applied to the damper flap (14) to open it when it is stuck shut, either by the accumulation of water frozen in place or by the accumulation of foreign material around the edge of the damper flap, the cable (18) is pulled beyond its closed position such that it rotates the bar (46) of the bar and extension pin element (22). As the bar (46) is rotated, the extension pin (50) extends through the extension pin opening (54) in the damper flap (14) to contact the bottom of the flange (24). By further pulling of the cable (18), the extension pin (56) forces the damper flap (14) apart from the frame (12), thus freeing it for rotation to its open position.

What is claimed:

1. A chimney damper comprised of (a) a frame;

(b) a damper flap pivotally mounted on the frame;

(c) a bar and extension pin member comprised of a bar pivotally mounted to the bottom of the damper flap and an extension pin member containing an extension pin which, when extended, will extend through an opening in the damper flap to engage the frame; and (d) a cable secured to the damper flap and the bar and extension pin member.

2. The chimney damper of claim 1 wherein more than one bar and extension pin member is secured to the bottom of the damper flap, means for the bars and extension pin members to act in concert.

3. The chimney damper of claim 1 wherein the frame contains a substantially u-shaped inwardly turned channel.

4. The chimney damper of claim 1 wherein the damper flap is pivotally mounted to the frame by a pivot means such that a portion of the damper flap on one side of the pivot means is heavier than that portion of the damper flap on the other side of the pivot means.

5. The chimney damper of claim 1 wherein the cable is secured to the damper flap by securing the cable through a spring member which is itself secured to the damper flap.

6. The chimney damper of claim 1 wherein the extension pin is forced away from the bottom surface of the chimney damper by an extension pin spring.

7. The chimney damper of claim 1 wherein the cable is secured to the damper flap and the bar and extension pin member such that upon pulling on the cable the damper flap will close and upon further pulling on the cable, the extension pin of the bar and extension pin member will extend through the opening in the damper flap.

8. The chimney damper of claim 1 wherein a second bar and extension member is secured to the bottom of the damper flap and means for the bar and extension pin member and the second bar and extension pin member act in concert.

9. The chimney damper of claim 7 wherein the cable passes through a support arm which supports the cable.

10. The chimney damper of claim 5 wherein the cable is split into two elements, one secured to the spring member and one secured to the bar and extension pin member.

* * * * *